US010961776B2

(12) United States Patent
Berman et al.

(10) Patent No.: US 10,961,776 B2
(45) Date of Patent: Mar. 30, 2021

(54) WINDOW SHADE SYSTEM SAFETY DEVICE

(71) Applicant: MECHOSHADE SYSTEMS, LLC, Middleton, WI (US)

(72) Inventors: Joel Berman, Hewlett, NY (US); Stephen Hebeisen, Amawalk, NY (US); Eugene Miroshnichenko, Oceanside, NY (US); Xi Ming Liarno, Bergenfield, NJ (US)

(73) Assignee: MECHOSHADE SYSTEMS, LLC, Middleton, WI (US)

( * ) Notice: Subject to any disclaimer, the term of this patent is extended or adjusted under 35 U.S.C. 154(b) by 353 days.

(21) Appl. No.: 15/968,564

(22) Filed: May 1, 2018

(65) Prior Publication Data

US 2018/0347274 A1 Dec. 6, 2018

Related U.S. Application Data

(60) Provisional application No. 62/514,480, filed on Jun. 2, 2017.

(51) Int. Cl.
*E06B 9/84* (2006.01)
*E06B 9/68* (2006.01)
(Continued)

(52) U.S. Cl.
CPC ..... *E06B 9/84* (2013.01); *E06B 9/42* (2013.01); *E06B 9/50* (2013.01); *E06B 9/68* (2013.01); *E06B 2009/6818* (2013.01)

(58) Field of Classification Search
CPC ..... E06B 9/42; E06B 9/50; E06B 9/80; E06B 9/84; E06B 2009/804; E06B 2009/802; E06B 9/68; E06B 9/08; E06B 9/11; E06B 9/17; E06B 9/17007; E06B 2009/1743; E06B 2009/1746; E06B 9/34; A47H 1/10;
(Continued)

(56) References Cited

U.S. PATENT DOCUMENTS 1,742,549 A * 1/1930 Macarthur ..... E06B 9/58 242/595.1
3,900,063 A * 8/1975 Roller ..... E06B 9/17 160/310

(Continued)

OTHER PUBLICATIONS

Catch Pin Bracket, copyright 2013, by MechoShade Systems, accessed Oct. 2, 2020 from https://studylib.net/doc/18776114/catch-pin-bracket (Year: 2013).*

(Continued)

*Primary Examiner* — Johnnie A. Shablack
*Assistant Examiner* — Jeremy C Ramsey
(74) *Attorney, Agent, or Firm* — Snell & Wilmer L.L.P.

(57) ABSTRACT

A safety device for a window shade system comprising a shade tube having a first end mounted to a first bracket 100 and a second end mounted to a second bracket. The system also includes a first plurality of catchpins 110 mounted to the first bracket, wherein the first plurality of catchpins 110 are mounted below the first end of the shade tube. In response to the first end of the shade tube disengaging from the first bracket, the first plurality of catchpins 110 catch the first end of the shade tube and prevent the first end of the shade tube from further falling.

17 Claims, 9 Drawing Sheets

(51) Int. Cl.
*E06B 9/42* (2006.01)
*E06B 9/50* (2006.01)

(58) Field of Classification Search
CPC ... A47H 1/13; A47H 1/14; A47H 1/18; A47H 1/144
See application file for complete search history.

(56) References Cited

U.S. PATENT DOCUMENTS

| | | | | |
|---|---|---|---|---|
| 5,743,320 | A * | 4/1998 | McKeon | E06B 9/82 160/291 |
| 2006/0060313 | A1* | 3/2006 | Lukos | G03B 21/58 160/242 |
| 2012/0133315 | A1* | 5/2012 | Berman | E06B 9/68 318/480 |
| 2015/0368970 | A1* | 12/2015 | Chambers | E06B 9/50 160/323.1 |
| 2018/0195342 | A1* | 7/2018 | Geiger | E06B 9/42 |

OTHER PUBLICATIONS

MechoSystems, Catch-Pin Bracket, Mar. 22, 2016. accessed from https://twitter.com/mechosystems/status/712270322926546944?lang=en (Year: 2016).*

* cited by examiner

WINDOW SHADE SYSTEM SAFETY DEVICE

CROSS-REFERENCE TO RELATED APPLICATIONS

This application claims priority to, and the benefit of, U.S. Ser. No. 62/514,480, entitled "Window Shade Safety Device" filed on Jun. 2, 2017, which is hereby incorporated by reference in its entirety for all purposes.

FIELD

This disclosure generally relates to window shade systems, and more particularly, to safety devices for restricting the shade tube from falling from the window shade brackets.

BACKGROUND

A window shade system includes a window shade (e.g., roller shade) that is typically wound around a shade tube. The shade tube is typically mounted to a bracket on each end. The brackets are mounted to a wall or other structure. The window shade system may include brackets mounted in a window pocket, overhead, ceiling mounted, jamb mounted, a top-down mounting, sloped mounting, horizontal mounting and/or skylight mounting. The window shade system may be in excess of 400 pounds. As such, it is important to secure the window shade system to prevent any portion from falling.

The window shade system is a very secure structure, if mounted, maintained and used correctly. However, in very rare situations, the window shade system may become dislodged from the window shade system not being properly installed, wear and tear, building movements, obstructions and/or the like. Moreover, the shade tube may slip off the brackets 100, for example, when the distance between the brackets could be set up larger than required, drive and idle ends of the tube may not be properly secured in the corresponding brackets 100, the window shade system may be mounted such that the brackets become loose, a dimensional change in the distance between brackets may occur due to building movement or changes, the supports may be out of level and/or the wall that retains the brackets may degrade. Moreover, in very rare situations, the window shade system may not be properly maintained such that the components cause friction (e.g. against other components or against the supporting structure) which results in breaking or disengaging of the components. The window shade system may also be controlled with a motor, wherein the motor receives instructions from a switch or software. As such, the motor, electronics and/or software may cause the window shade to malfunction. For example, the window shade may get caught, but the motor keeps rotating which may cause the shade tube (and/or other hardware attached to the shade tube) to disengage from the brackets. Additionally, in very rare situations, the shade may also fall due to a failure of the motor or idle end attachment.

As a result of any of these very rare malfunctions, the shade tube may dislodge from one or both of the brackets. If the shade tube dislodges, the shade tube may unfortunately fall down and injure people or damage property. As such, an important need exists to secure the window shade system with a redundant security device to avoid damage or injury, in case the mounting system for the window shade system fails.

BRIEF DESCRIPTION OF THE DRAWINGS

The subject matter of the present disclosure is particularly pointed out and distinctly claimed in the concluding portion of the specification. A more complete understanding of the present disclosure may be obtained by referring to the detailed description and claims when considered in connection with the drawing figures, wherein like numerals denote like elements. Each of the various Figures and components may be in accordance with various embodiments of the disclosure.

DETAILED DESCRIPTION

The features and elements discussed herein may be combined in various combinations without exclusivity, unless expressly indicated herein otherwise. These features and elements as well as the operation of the disclosed embodiments will become more apparent in light of the following description and the accompanying figures. The detailed description of various embodiments herein refers to the accompanying drawings and pictures, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 2:
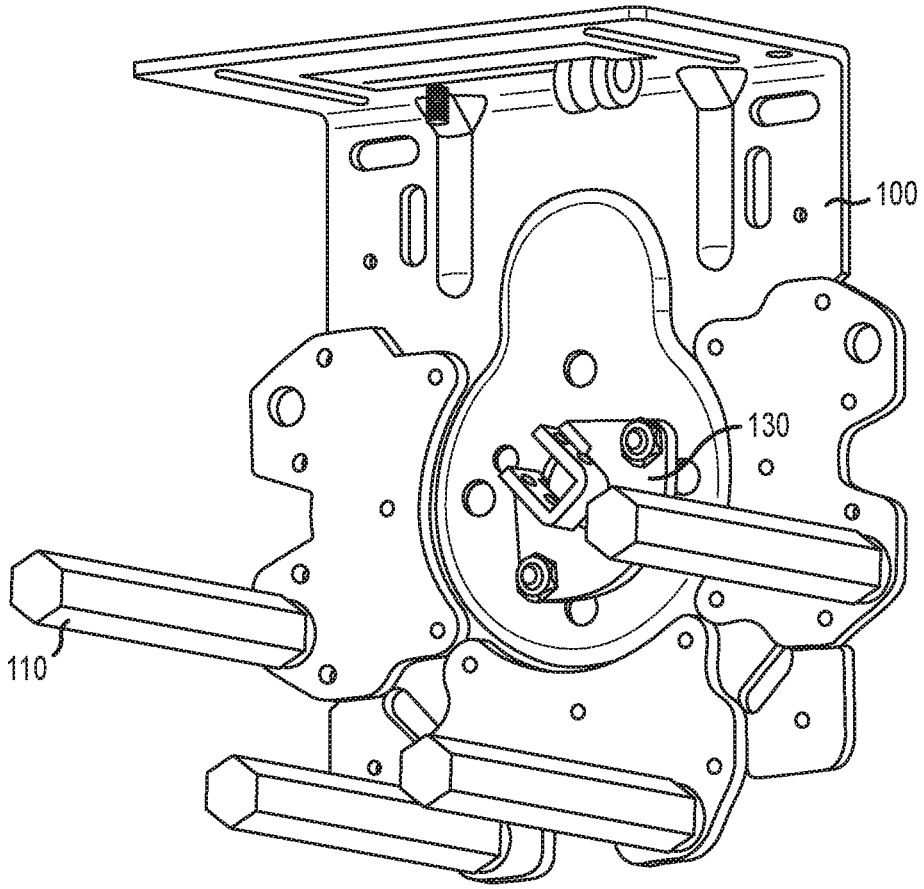
FIG. 2 shows an exemplary ceiling mount drive end bracket 100 having a round head motor attachment 130 and having an exemplary catchpin 110 arrangement, in accordance with various embodiments.
Figure 7:
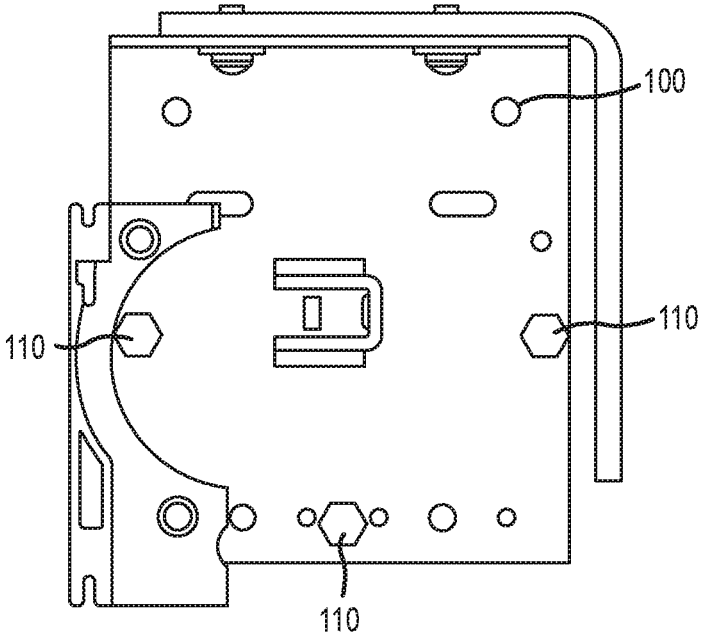
FIG. 7 shows an exemplary drive end bracket 100 having another exemplary catchpin 110 arrangement, in accordance with various embodiments.

The window shade system may include brackets 100 mounted in a window pocket, overhead, ceiling mounted, face/wall mounted, jamb mounted, a top-down mounting, sloped mounting, horizontal mounting and skylight mounting. The brackets 100 may support any size diameter of tube. For example, the brackets 100 may include a tube diameter of 2.5 inch, 3.5 inch, 4.5 inch, 6 inch or larger. As shown in FIG. 2, certain brackets 100 may accommodate the larger shade tubes (3.5"-6" tubes) and such brackets 100 may need stronger safety devices and more pins. The window shade system may or may not include fascia. As shown in FIG. 7, certain brackets 100 may accommodate smaller tubes (2.2"-2.5" tubes) and such brackets 100 may work with less pins. The top flange may be any size. For example, the top flange may be a wide top flange for better access to the mounting hardware around the shade tube. The mounting flange may also include slots for easy adjustment in projection and width.

Figure 1:
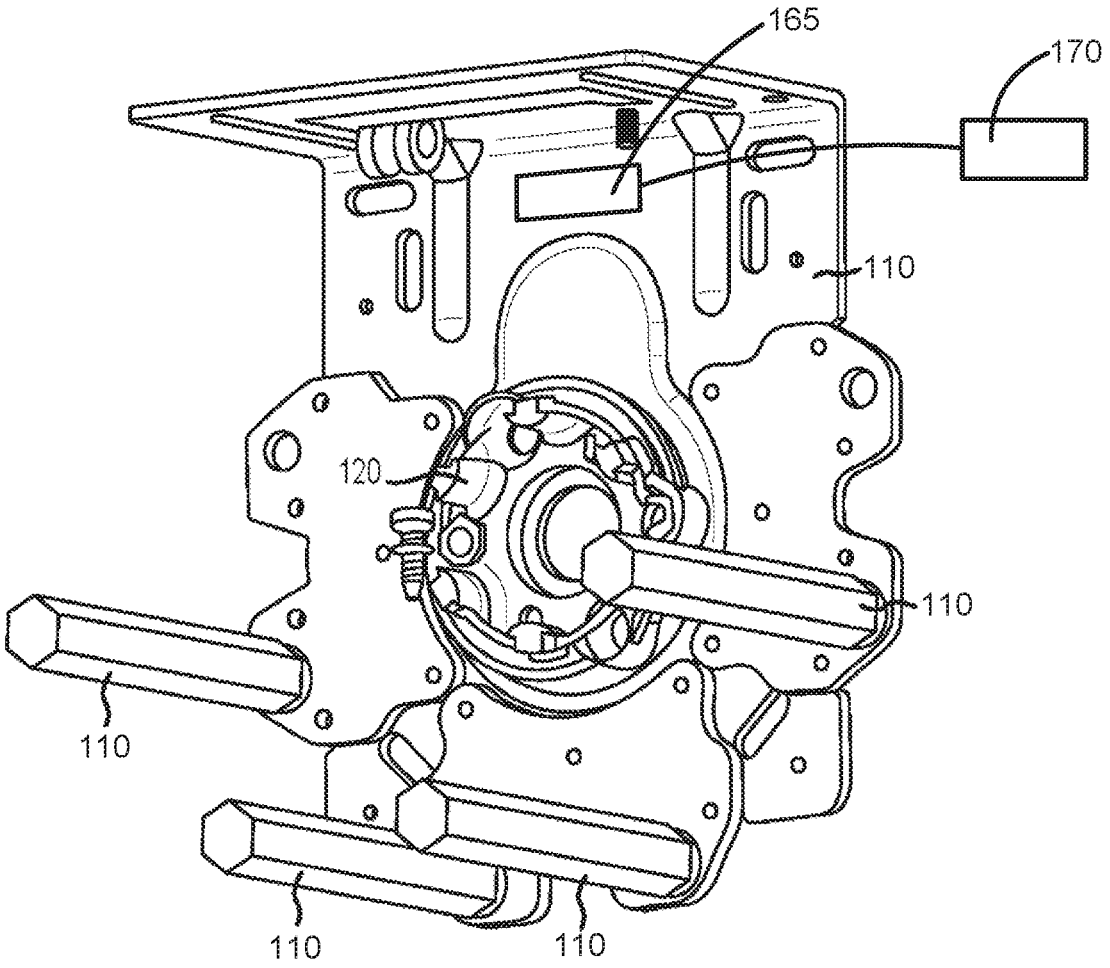
FIG. 1 shows an exemplary ceiling mount drive end bracket 100 having a star head motor attachment 120 and having an exemplary catchpin 110 arrangement, in accordance with various embodiments.

The window shade system may support any motor or a manual adjustment mechanism. For example, a round-head motor attachment 130 as in FIG. 2 or a star-head motor attachment 120 as in FIG. 1. The star-head motor attachment 120 typically includes higher torque that provides stronger (more power) turning, even if it has a slower speed rotation. The system may also include a safety device such as any retaining device (e.g., pin, cotter pin, retaining ring, etc.) placed in front of the motor compartment, to restrict the motor from sliding out of the motor compartment or vibrating itself outside of the motor compartment. If such a shade tube becomes dislodged, a safety device may be needed to restrain the shade tube. For example, the higher torque may be more likely to break through weaker safety devices.

In various embodiments, the window shade system may include any safety device that may support or restrict the shade tube while the shade tube is attached to the bracket 100 and/or after the shade tube dislodges from the bracket. The safety device may include a stronger CatchPin® brand safety device ("catchpin"), multiple catchpins 110, surface catches, tethers or any other safety device. The safety device minimizes risk to an entity (e.g., tenant, landlord, property manager, building owner, etc), reduces legal exposure, avoids bad public relations and protects the public.

In various embodiments, the window shade system may include any number or arrangement of catchpins 110. The catchpins 110 may be any shape. In various embodiments, the catchpins 110 are hexagonal shape to allow the catchpin 110 to be more easily grabbed by a tool. In contrast, a tool grabbing a rounded catchpin 110 would typically slip, along with leaving marks on the surface of the catchpin. One or more of the catchpins 110 may include a coating (e.g., rubber) or surface treatment to minimize slippage and/or reduce sounds. The catchpins 110 may be mounted onto any part of the window shade system. For example, one or more of the catchpins 110 may be mounted to one or more of the brackets 100. In various embodiments, the catchpins 110 are mounted onto a plate, and the plate is mounted to the bracket. Mounting the pin(s) to the plate provides advantages with manufacturing the system and advantages with easier removal of the pins and/or plates from the bracket. For example, the pieces may be fabricated separately and assembled separately, which allows a variety of different sizes, numbers and arrangements of pieces to be used on different brackets 100 for different purposes.

In various embodiments, one or more of catchpins 110 may include a "spinning pin". The spinning pin may include a bearing sleeve around the pin shaft, such that the bearing sleeve turns with the impact of a spinning shade tube. The spinning pin may prevent a shade from "walking out" of the bracket. The rotating shade may dissipate energy onto the spinning pin to also reduce the rotational and other forces associated with the falling shade. The spinning pin may reduce the rebounding forces of the shade assembly within the catchpin area. The spinning pin may also push the shade toward other pins. Moreover, if one or more pins are less than fully effective, the spinning of the pin may still help to restrict the falling shade. A pin may be less than fully effective if the pin is not placed properly during installation, not replaced properly after maintenance, or was removed completely.

In addition to the shade tube size, shade weight, and mounting conditions, the location of a shade system may impact the configuration of a safety device. For example, high bay shades may need extra support and security because the higher shades may be harder to service, so the shades may be serviced less often (or never serviced). Moreover, the radius of impact for damage and injury is greater from a falling shade from a higher location. The shade and other components may be more likely to hit and/or ricochet off of surrounding structures. For example, the impact of a 100 pound shade falling from 30 feet high is greater than the impact of a 100 pound shade falling from 10 feet high. Furthermore, a shade may need additional or stronger safety devices if the shade is located in an area with more people or objects (cars, furniture, electronics, etc.), above a more centralized area where people are located, in a school, in a daycare center, and/or in an area subject to more environmental hazards (wind, hurricane, tornado, earthquake, seismic activity, etc.). High bay shades are typically installed in more public places such as atriums and lobbies. In that regard, more people typically walk under, sit under or stand under the shades than in a normal office environment. As such, additional, larger and/or stronger safety devices may be included in a shading system that is installed in a higher location, a more public location or a more crowded location.

The diameter of the shade tube may determine the separation distance between the pins. For example, the pins are close enough to not allow the shade tube to fall between the pins, and instead, the pins catch the shade tube because the shade tube diameter is larger than the space between the pins. Depending on the diameter of the shade tube, additional catchpins 110 may be used in order to avoid too large of a separation between the catchpins 110 and to allow the tube to be caught by the pins. For example, the opening between adjacent catchpins 110 may be less than about 90% of the shade tube diameter. However, the catchpins 110 need to be far enough away from the shade tube to allow the fabric to roll-up onto the shade tube. For example, a 2.5 inch diameter shade tube may need 5 inch diameter clearance after the fabric is rolled onto the tube. As such, the pins may need to be dispersed on a wider radius to avoid the fabric role. Because the pins are dispersed on a wider radius, additional pins may need to be included on the bracket in order to maintain the reduced spacing between the pins for catching the shade tube with or without the fabric rolled onto the shade tube.

Figure 8:
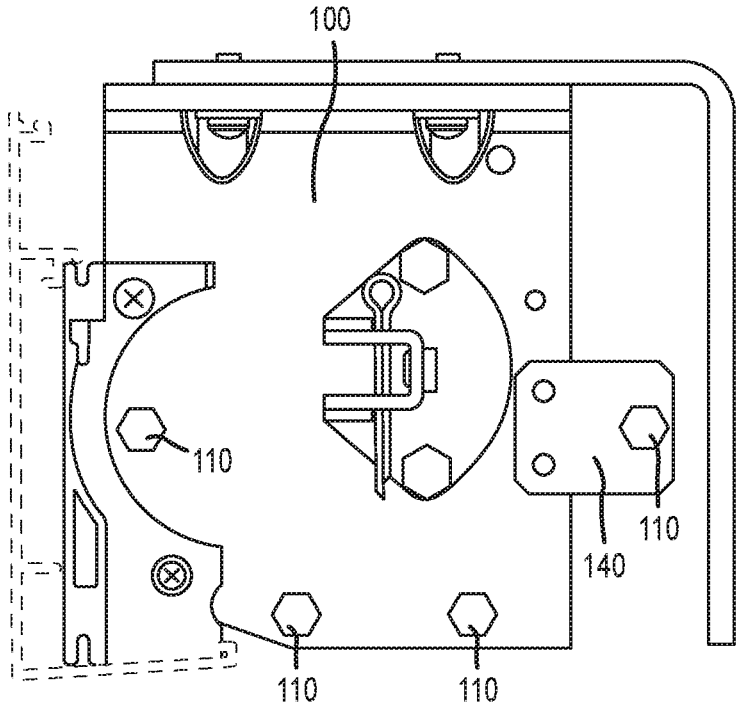
FIG. 8 shows an exemplary drive end bracket 100 having another exemplary catchpin 110 arrangement, a plate/clip to attach a fascia and a cotter pin to secure the motor, in accordance with various embodiments.
Figure 9:
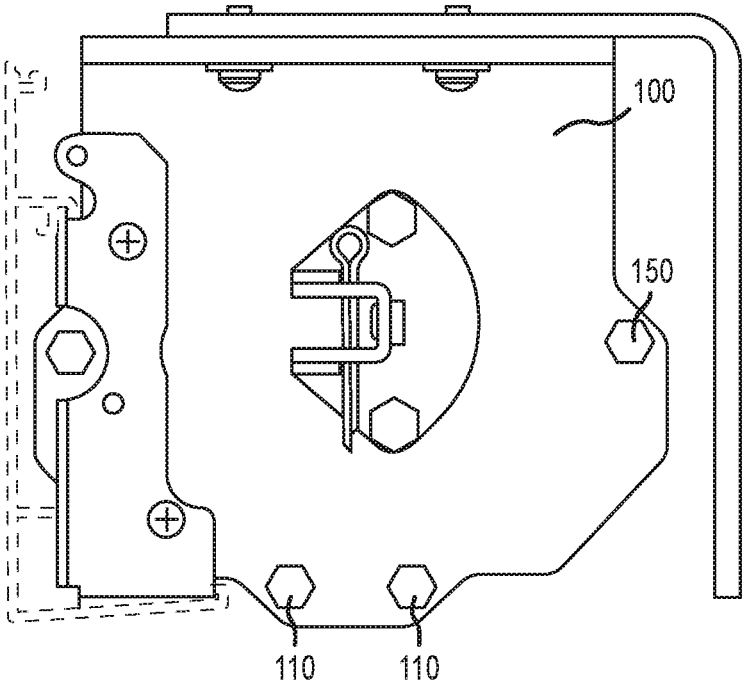
FIG. 9 shows an exemplary drive end bracket 100 having another exemplary catchpin 110 arrangement, in accordance with various embodiments.

The catchpins 110 may include a threaded end or a pressure fit end into an opening in the bracket, such that the catchpins 110 may be removable for shade installation and replaceable after installation. The bracket 100 may include additional openings such that the installer can install additional pins (threaded or pressure fit) for additional support during installation or afterwards. A pin holder or an extender plate 140 may be used to add additional pins and/or extend the pin location beyond the existing bracket 100 surface, as shown in FIG. 8. The bracket 100 in FIG. 8 is designed to hold a larger shade tube such that the bracket 100 is further from the wall on the right side. As such, excessive space now exists between the bracket 100 and the wall (and from the other catchpins 110), so an additional catchpin 110 is mounted on the extender 140 to allow the additional catchpin 110 to be further out. The bracket 100 may also be shaped such that the bracket is extended and the catchpin 150 is on the extended portion of the bracket, without the need for an extender 140 (or both an extender and catchpin 110 may be used).

Figure 3:
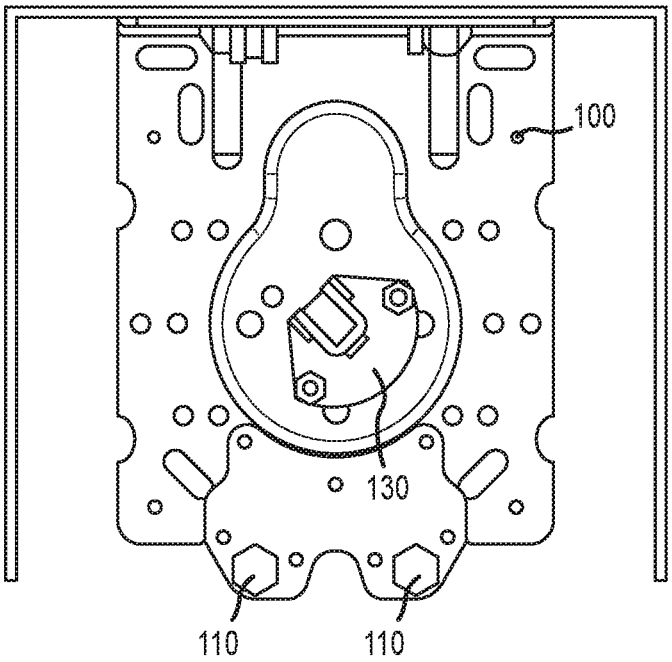
FIG. 3 shows an exemplary drive end bracket 100 mounted inside a pocket having a round head motor attachment 130 and having an exemplary catchpin 110 arrangement, in accordance with various embodiments.
Figure 4:
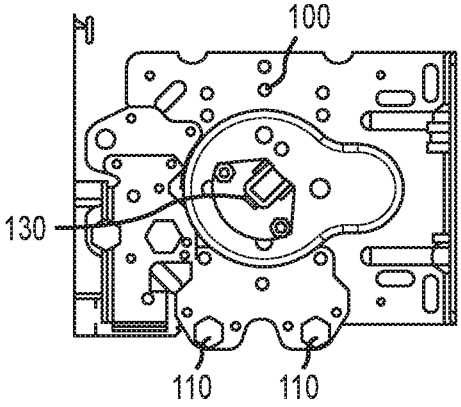
FIG. 4 shows an exemplary wall mount drive end bracket 100 having a round head motor attachment 130, a plate/clip to attach a fascia and an exemplary catchpin 110 arrangement, in accordance with various embodiments.
Figure 5:
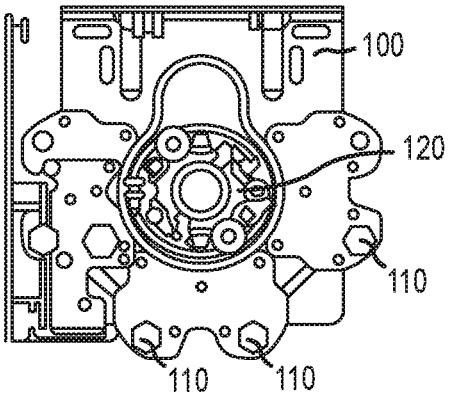
FIG. 5 shows an exemplary ceiling mount drive end bracket 100 having a star head motor attachment 120, a plate/clip to attach a fascia and an exemplary catchpin 110 arrangement, in accordance with various embodiments.
Figure 6:
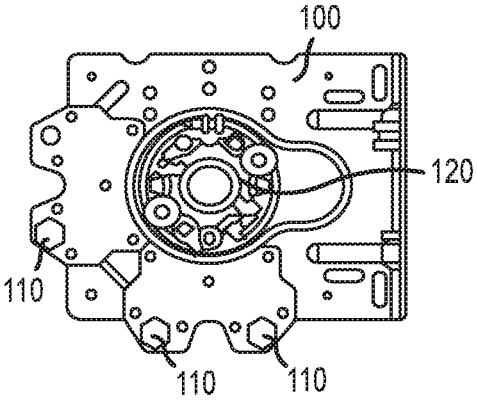
FIG. 6 shows an exemplary wall mount drive end bracket 100 having a star head motor attachment 120, with no fascia or fascia clips and an exemplary catchpin 110 arrangement, in accordance with various embodiments.

While providing catchpins 110 below (e.g., between the shade tube and the ground) the shade tube may be sufficient to prevent a direct fall of the shade tube, one or more additional catchpins 110 may be inserted towards the side of the shade tube or above the shade tube. The side or top catchpins 110 may help prevent the shade tube from moving away from or bouncing off the catchpins 110 below the shade tube and exiting the side or top of the window shade system. A window shade system that includes a front fascia or top fascia may not need a catchpin 110 in the front or top because a properly constructed and dimensioned fascia may prevent the shade tube from exiting the front or top of the window shade system. A window shade system may also be mounted in a pocket (as shown in FIG. 3). Less pins (e.g., only 2 pins in FIG. 3) may be used in a pocket mounting because the pocket already provides three sides of barrier protection. Moreover, a bottom closure in the pocket may also prevent the shade tube from exiting.

Figure 10:
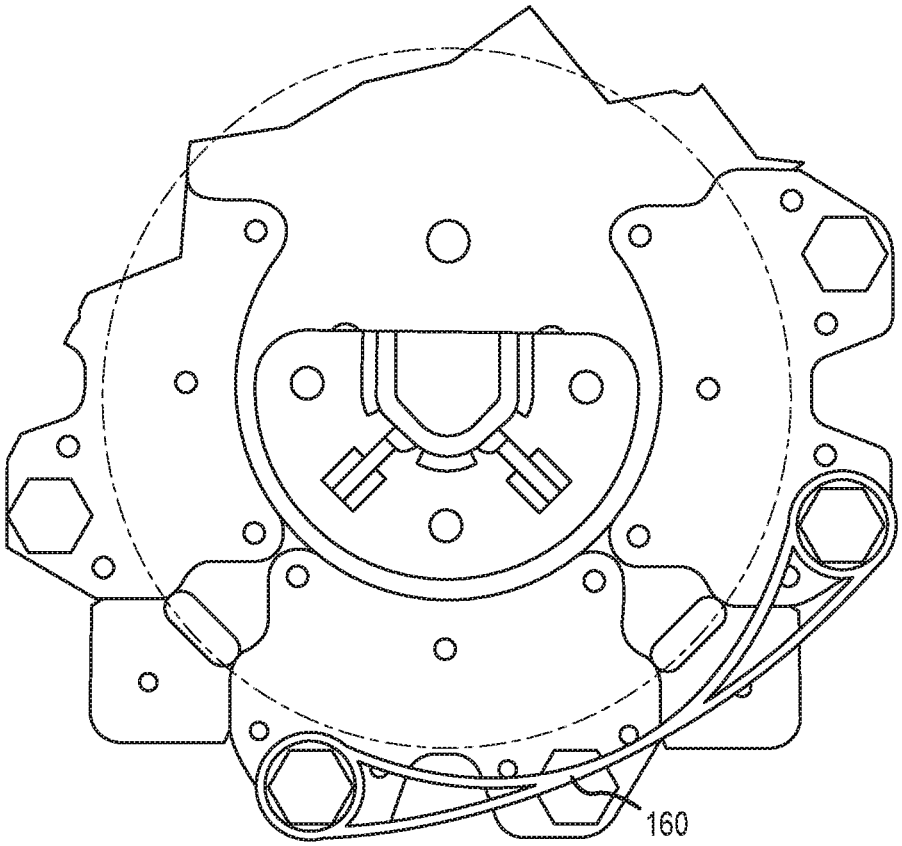
FIG. 10 shows an exemplary drive end bracket 100 having an exemplary catchpin 110 arrangement and having a sleeve over certain catchpins 110 and extending between the catchpins 110, in accordance with various embodiments.
Figure 11:
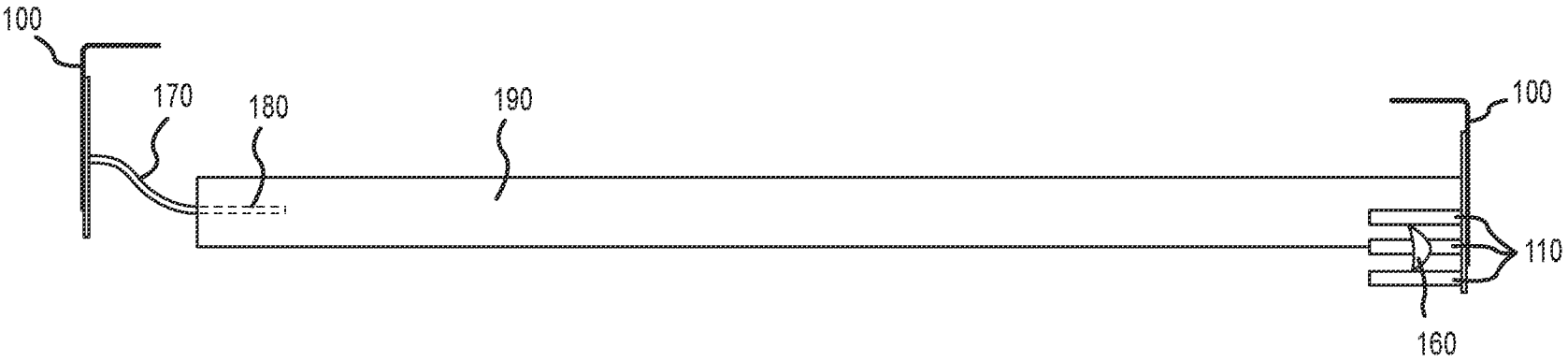
FIG. 11 shows an exemplary shade tube 190 between a first bracket 100 and a second bracket 100, wherein the shade tube 190 dislodged from the second bracket 100, but is prevented from fully falling by the tether 170 having a tether rod 180 inserted into the shade tube 190, in accordance with various embodiments.

In various embodiments, and as shown in FIG. 10, the surface catch 160 may include any surface, sleeve, channel, plate, net or device that may support or restrict the shade tube while the shade tube is attached to the bracket 100 and/or after the shade tube dislodges from the bracket. The surface catch 160 may be comprised of metal, plastic, rubber, wire mesh and/or any other materials. The surface catch 160 may restrict or prevent the shade tube from falling, after the shade tube is partially or fully dislodged from the bracket. For example, the surface catch 160 may include a curved surface or curved cup. The curved cup may be mounted within the bracket, mounted on the supporting structure and/or mounted from the fascia. The surface catch may allow the shade to unroll and extend from the window shade system. The catchpins 110 may also allow the shade to unroll and extend in case of bracket 100 attachment failure. As such, the surface catch may include two separated pieces, one piece with a slot or any other arrangement that provides minimal or no interference with the unrolling of the shade. When including a sleeve in the bracket 100 for catching the shade tube, the catchpins 110 may be placed wider apart (e.g., wider than the shade tube) or one or more catchpins 110 may be removed.

In various embodiments, the window shade system may also include a tether 170. The tether 170 may include a rod 180 inserted into the shade tube 190, through a tube plug and/or through the motor head. The tether rod 180 may be secured to one or more of the brackets 100 or one or more locations on the wall. If the shade tube 190 partially or fully dislodges from the bracket 100, the tether rod 180 still restricts the shade tube because the tether rod 180 is still connected on one or both ends. The window shade system may include a motor on a first end. The window shade system may also include a motor on each end for a dual-motor powered shade. The tether rod 180 may only be connected to the second end of shade tube 190. If the shade tube dislodges, then the tether rod 180 maintains the connection on the second end. In that regard, the shade tube 190 may fall to a full or partial vertical position, but the shade tube 190 is still connected to the second bracket via the tether 170. As such, the shade tube 190 is prevented from fully falling.

The safety devices may be supplemented with sensors. The sensors may act as part of a feedback control system that can stop the motor to avoid or minimize damage. In various embodiments, the window shade system may include a sensor or meter to detect acceleration/deceleration (which provides data that can be interpreted as vibration or seismic activity) and/or movement of the window shade system or any component thereof. The sensor may be, for example, an accelerometer (e.g., tri-axial accelerometer). However, such sensor data may be of little value if the system is not able to react or prevent damage. As such, the system is able to compensate for such undesirable movements by incorporating catchpins, tethers and/or other safety devices to prevent or minimize the damage caused by such undesired movements.

In that regard, the sensor 165 may be in communication with a monitoring system 170, wherein if the monitoring system 170 determines that the acceleration/deceleration (or vibration), location and/or movement is within an unacceptable level, the monitoring system 170 may activate a notification system. The notification system may send a stop signal to the motor, such that the motor stops rotation to limit the damage of the shade tube in response to the tube dislodging or excessively vibrating. The power disconnect may also include a physical disconnect using, for example, vibration switches or interlock switches.

The notification system may include a notification near the window shade system, a notification to a building management system, a notification to a smart phone, a notification to first responders, a notification to a property manager, building security or owner, a notification to a landlord, a notification to a government compliance officer (e.g., OSHA) or any other system or person. The notification may be sent to an environmental monitoring system and/or window shade adjustment system such as the SolarTrac® system manufactured by MechoShade Systems, LLC of Long Island City, New York. The SolarTrac® system is further described in U.S. Ser. No. 14/692,868, filed Apr. 22, 2015 and entitled "Automated Shade Control System Interaction with Building Management System," which is hereby incorporated by reference in its entirety for all purposes. The SolarTrac® system may react by stopping or adjusting the window shade system or developing a strategy with the building management system to minimize damage or safety issues.

The notification may include an audible alarm, a visual alarm, a message or the like. The notification may include a signal to deactivate or restrict the window shade system from further adjustments. The notification may also put the window shade system into a safety mode. For example, the catchpins 110 or tether may interface with a motor or device that moves one or more catchpins 110 closer to each other, extends one or more catchpins 110 further out, moves one or more catchpins 110 closer to the shade tube, adjusts one or more holders of the tether such that increased tension is provided to the tether. For the pins that may be configured as longer pins or move further out in response to a notification to provide more support, such pins may be configured to be reinforced to compensate for the extra length with, for example, stronger materials, reinforced with stronger composites, reinforced with additional elements (e.g., rebar), increased diameter, etc. As such, the notification may cause the tether to increase its tension on the shade tube, or cause the pins or surface catch to move closer to the shade tube (e.g., to better prepare for a dislodged shade tube and prevent the tube from further falling).

The safety devices may also be used to satisfy seismic testing requirements for window shade systems. During a seismic event, the top part of a window wall may move more than the bottom part of a window wall. Such additional movement near the top where the brackets are located may increase the distance between the brackets, causing the shade tube to dislodge from the one or more of the brackets. Seismic testing may involve translation on the order of 3-4 inches on a triaxial vibration/shake table to pass the test, wherein the brackets may move with respect to each other in any direction 3-4 inches. As such, the safety devices discussed herein may provide a key solution for a window shade system to obtain seismic testing approval. For example, an increased length of the catchpins may still catch the shade tube, despite such a large translational movement of the walls and brackets. The shade system may be able to retain its structural integrity and functionality, despite the seismic activity. Moreover, with the use of the safety devices, the shade system components may be able to avoid extensive damage, such that the components may be able to be re-installed after being dislodged and/or after a seismic event.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims.

Any reference to attached, fixed, connected or the like may include permanent, removable, temporary, partial, full and/or any other possible attachment option. Additionally, any reference to without contact (or similar phrases) may also include reduced contact or minimal contact. Different cross-hatching is used throughout the figures to denote different parts but not necessarily to denote the same or different materials. Surface shading lines may be used throughout the figures to denote different parts or areas but not necessarily to denote the same or different materials. In some cases, reference coordinates may be specific to each figure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

The invention claimed is:

1. A safety device for a window shade system comprising:

a shade tube having a first end mounted to a first bracket and a second end mounted to a second bracket;

a first plurality of catchpins mounted to the first bracket, wherein the first plurality of catchpins are separated from and mounted below the first end of the shade tube such that the shade tube when mounted to the first bracket does not provide a force on the first plurality of catchpins; and a surface catch mounted to a first catch pin and a second catch pin of the plurality of catchpins, wherein in response to the first end of the shade tube disengaging from the first bracket, the first end of the shade tube is configured to fall into the surface catch, and the first plurality of catchpins and the surface catch catch the first end of the shade tube and prevent the first end of the shade tube from further falling.

2. The system of claim 1, further comprising a second plurality of catchpins mounted to the second bracket, wherein the second plurality of catchpins are mounted below the second end of the shade tube, wherein in response to the second end of the shade tube disengaging from the second bracket, the second plurality of catchpins catch the second end of the shade tube and prevent the second end of the shade tube from further falling.

3. The system of claim 1, further comprising a pin extender coupled to the first bracket, wherein the pin extender is coupled to one or more of the plurality of catchpins and extends a location of the one or more of the plurality of catchpins beyond a surface of the first bracket.

4. The system of claim 1, further comprising a tether mounted inside the shade tube and mounted to the second bracket, wherein in response to the first end of the shade tube disengaging from the first bracket, the tether catches the second end of the shade tube and prevents the first end of the shade tube from further falling.

5. The system of claim 1, wherein the first bracket is configured to receive additional catchpins around the shade tube that is installed into the first bracket.

6. The system of claim 1, wherein the first bracket and the second bracket are mounted at least one of in a window pocket, overhead, on a ceiling, against a wall, to a jamb, top-down, sloped, horizontal or in a skylight.

7. The system of claim 1, wherein the first plurality of catchpins is configured to allow a window shade on the shade tube to unroll.

8. The system of claim 1, further comprising at least one of a fascia or first flange on the first bracket.

9. The system of claim 1, further comprising a first flange on the first bracket, wherein the first flange includes a slot to access mounting hardware around the shade tube, wherein the mounting hardware is configured to adjust the shade tube.

10. The system of claim 1, further comprising at least one of a motor attachment or manual adjustment mechanism that turns the shade tube.

11. The system of claim 1, further comprising a retaining device in front of a motor compartment to restrict a motor from exiting the motor compartment.

12. The system of claim 1, further comprising a monitoring system configured to monitor data from the window shade system, wherein the monitoring system includes a feedback control system configured to receive the data about the window shade system and provide feedback to the window shade system for stopping a motor to avoid damage, wherein the monitoring system determines that an acceptable range of an amount exists for at least one of acceleration, deceleration, vibration, location or movement.

13. The system of claim 1, further comprising a monitoring system configured to monitor data from the window shade system, wherein the monitoring system provides a notification to a notification system that sends a notification to at least one of an audible alarm, a visual alarm, a window shade adjustment system, an environmental monitoring system, a building management system, a smart phone, first responders, a property manager, a building security system, a building owner, a landlord, or a government compliance officer.

14. The system of claim 1, wherein a spacing between each of the first plurality of catchpins is less than a diameter of the shade tube such that the shade tube is caught by one or more of the first plurality of catchpins.

15. The system of claim 1, wherein a number of the first plurality of catchpins is dependent upon a diameter of the shade tube such that a larger number of the first plurality of catchpins are used to support the weight of a larger diameter of the shade tube and block the shade tube from falling.

16. The system of claim 1, wherein a spacing between each of the first plurality of catchpins is less than about 90% of a diameter of the shade tube.

17. The system of claim 1, wherein the first bracket 100 includes catchpins above the shade tube.

* * * * *